US007752688B2

(12) United States Patent
Chen et al.

(10) Patent No.: US 7,752,688 B2
(45) Date of Patent: Jul. 13, 2010

(54) PLAYARD

(75) Inventors: Hong-Bo Chen, Taipei (TW); Chih-Wei Wang, Taipei (TW)

(73) Assignee: Excellerate Enterprise Co., Ltd., Songshan District, Taipei (TW)

( * ) Notice: Subject to any disclaimer, the term of this patent is extended or adjusted under 35 U.S.C. 154(b) by 0 days.

(21) Appl. No.: 12/323,484

(22) Filed: Nov. 26, 2008

(65) Prior Publication Data

US 2009/0133190 A1 May 28, 2009

Related U.S. Application Data

(60) Provisional application No. 60/990,288, filed on Nov. 26, 2007.

(51) Int. Cl.
*A47D 7/00* (2006.01)

(52) U.S. Cl. ..... 5/93.1; 5/99.1; 5/98.1; 5/288; 5/655; 5/102; 403/102; 403/231

(58) Field of Classification Search ..... 5/93.1, 5/99.1, 98.3, 655, 634, 288, 286, 282.1, 112, 5/114, 116, 102; 403/102, 231, 52, 64, 65, 403/58

See application file for complete search history.

(56) References Cited

U.S. PATENT DOCUMENTS

| | | | | |
|---|---|---|---|---|
| 5,081,723 | A | 1/1992 | Saunders | |
| 5,241,717 | A * | 9/1993 | Ward et al. | 5/201 |
| 5,745,954 | A * | 5/1998 | Shogan et al. | 5/99.1 |
| 6,694,547 | B1 | 2/2004 | Vail | |
| 6,721,971 | B1 * | 4/2004 | Cheng | 5/99.1 |
| 6,859,957 | B1 * | 3/2005 | Chen | 5/93.1 |
| D550,003 | S * | 9/2007 | Fiore et al. | D6/503 |
| 7,568,242 | B2 * | 8/2009 | Troutman | 5/99.1 |
| 7,574,757 | B2 * | 8/2009 | Song | 5/99.1 |
| 2004/0071499 | A1 * | 4/2004 | Chen | 403/102 |
| 2005/0120522 | A1 * | 6/2005 | Church et al. | 24/265 R |
| 2005/0262629 | A1 | 12/2005 | Cheng | |
| 2007/0186344 | A1 * | 8/2007 | Cheng | 5/99.1 |
| 2007/0271698 | A1 | 11/2007 | Cyr | |
| 2008/0115269 | A1 * | 5/2008 | Chen et al. | 5/99.1 |
| 2009/0000028 | A1 * | 1/2009 | Wang | 5/93.1 |

FOREIGN PATENT DOCUMENTS

| | | |
|---|---|---|
| CN | 2800956 Y | 8/2006 |
| GB | 2 443 894 A | 5/2008 |

* cited by examiner

*Primary Examiner*—Robert G Santos
*Assistant Examiner*—Brittany M Wilson
(74) *Attorney, Agent, or Firm*—Winston Hsu

(57) ABSTRACT

Playard has a frame body that includes a top frame, a plurality of standing posts, and a bottom frame pivoting to one another so that the playard is foldable. A top corner of the standing post, top rails adjacent to the top corner, and the corresponding post body of the standing post form an arc-shaped surface structure. The top corner is mounted above the post body of the standing post by coupling a plug of the top corner to a socket of the post body. The standing post has two first engagements at two sides of its arc shape post body or on the wall of the socket. The enclosure has a second engagement at one end that can engage with the first engagement by sliding up and down relative to the standing post so that the enclosure is easily attached to or detached from the standing post.

14 Claims, 8 Drawing Sheets

PLAYARD

CROSS REFERENCE TO RELATED APPLICATIONS

This application claims the benefit of U.S. Provisional Application No. 60/990,288, which was filed on Nov. 26, 2007, and is incorporated herein by reference.

BACKGROUND OF THE INVENTION

1. Field of the Invention

The present invention relates to a playard, and more specifically, to a foldable playard with easily-assemble-detachable enclosures.

2. Description of the Prior Art

Playards in the market are often foldable. When not in use, the playard, which is composed with multiple sets of posts and enclosures can be folded via folding devices and pivots between each post and to a smaller size for transport or storage purpose.

In order to provide protection as well as ventilation and light-friendliness in playards, meshed or fabric enclosures can be wrapped around the frame body of the playard, and mattress suitable for lying thereon can be placed on the bottom of the frame body so that infant or toddler can enjoy in a comfortable and safe environment. In the prior art, however, many enclosures fix directly to the standing posts or other components of the frame body via screws and in such way, users have difficulties assembling the enclosures to or detaching them from the frame body. On the other hand, the fixed points between the enclosures and the frame body via screws are easy to crack by pulling the enclosures when the infant or toddler uses the playard or the playard is moved between a folded status and an extended status.

SUMMARY OF THE INVENTION

The present invention provides a playard. The playard includes a frame body and a plurality of enclosures. The frame body includes a top frame, a bottom frame, and a plurality of standing posts connecting to the top frame and the bottom frame. Each standing post has a pair of first engagements. Each enclosure has a pair of second engagements at two sides for detachably engaging with the corresponding first engagement of the standing post.

The present invention also provides a playard. The playard includes a frame body and an enclosure. The frame body includes a plurality of standing posts. Each standing post s a pair of protrusions. The enclosure has a connector at one end. The connector has a groove capable of detachably mounting on the protrusion for assembling the enclosure to the frame body.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
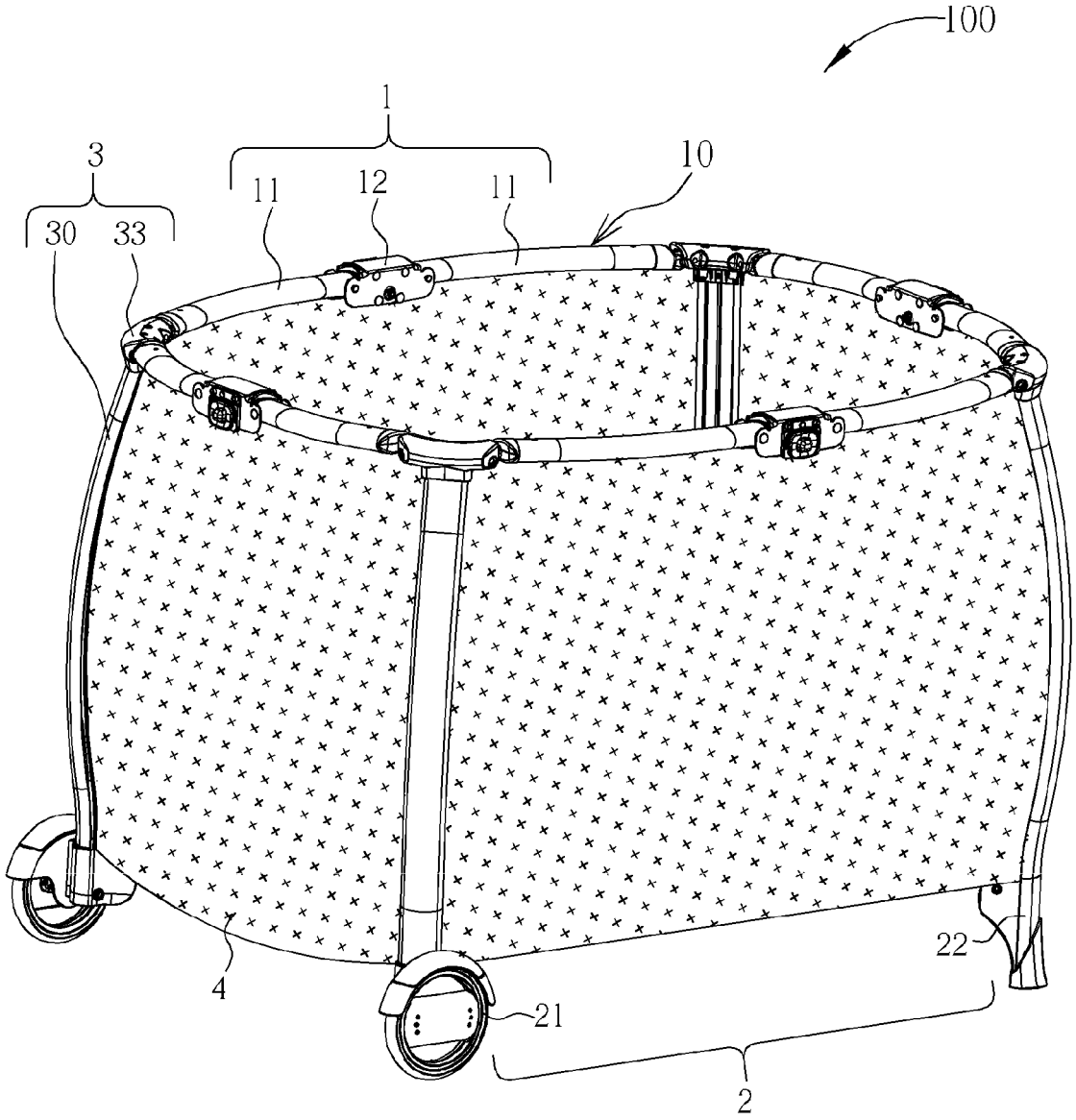
FIG. 1 is an illustration of a playard according to the present invention.
Figure 2:
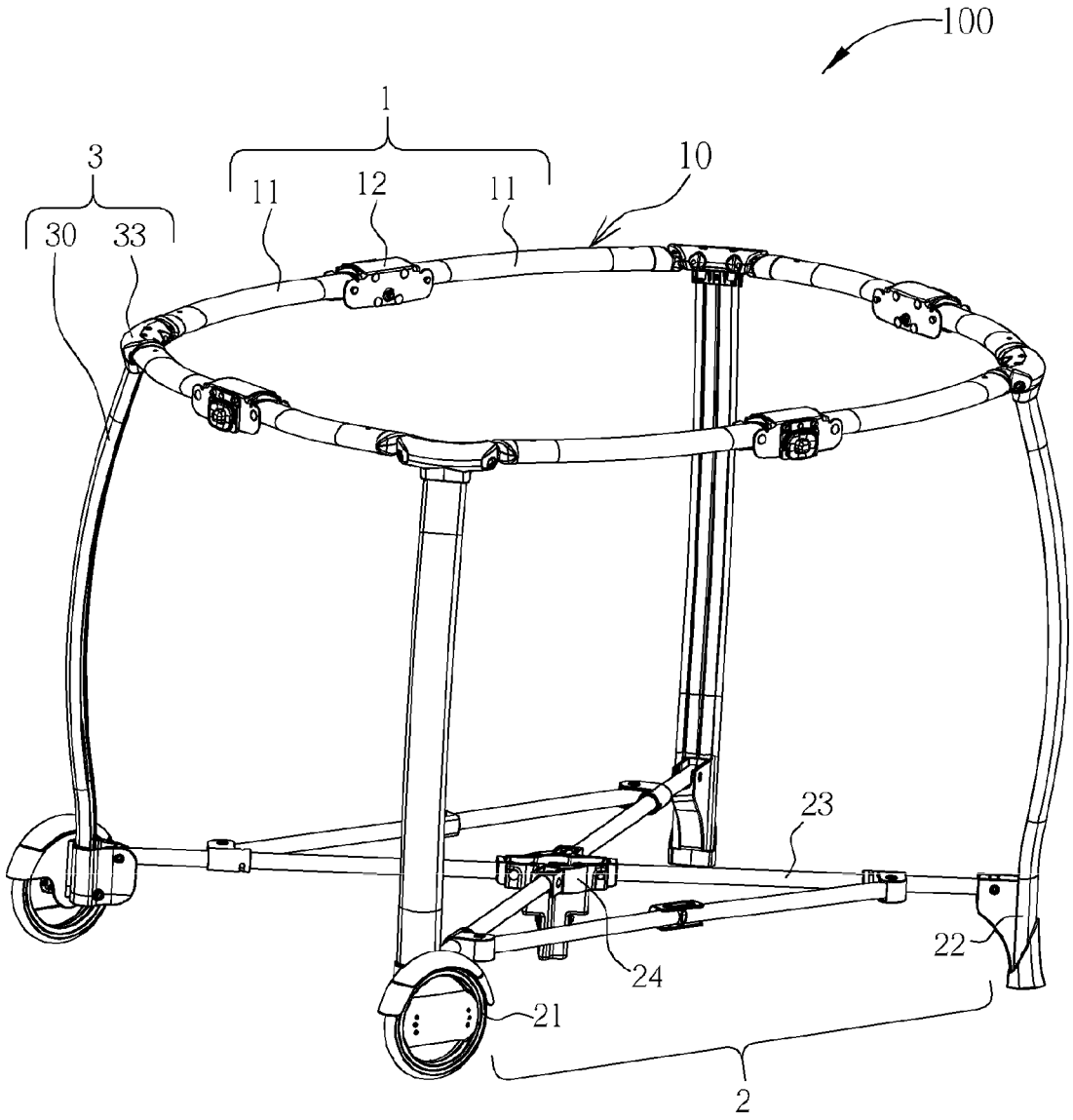
FIG. 2 is an illustration showing a frame body of the playard.

Please refer to FIG. 1 and FIG. 2. FIG. 1 is an illustration of a playard 100 according to the present invention, and FIG. 2 is an illustration showing a frame body 10 of the playard 100. The frame body 10 includes a top frame 1, a plurality of standing posts 3, and a bottom frame 2. The top frame 1 includes a plurality of top rails 11. Each top rail 11 connects to a corresponding standing post 3 and pivots to an adjacent top rail 11 via a pivoting piece 12. The bottom frame 2 includes a hub 24, a plurality of bottom posts 23, and a plurality of wheels 21 and feet 22. One end of each bottom post 23 pivots to the bottom end of the corresponding standing post 3 and the other end of the bottom post 23 pivots to the hub 24. In this embodiment, the bottom end of each standing post 3 of the frame body 10 pivotally connects to the bottom post 23 via the rotatable wheel 21 or the fixed foot 22 that are positioned on the bottom of the standing post 3. While in other embodiment, the playard 100 can also have all wheels 21 or all feet 22 at the bottom of the standing posts 3. The standing post 3 includes a post body 30 and a top corner 33 mounted above the post body 30. The top rail 11 connects to the standing post 3 by pivoting to the corresponding top corner 33. Enclosures 4 are mounted between the top frame 1, each standing post 3, and the bottom frame 2 of the frame body 10, which form the playard 100 toddlers can play therein. The enclosures 4 can be light-pervious or opaque fabrics that provides proper protection and shielding effect for the toddlers inside the playard 100. Additionally, since each component pivots to other component to form the frame body 10, pivoting each component relative to other component of the frame body 10 allows the frame body 10 to fold to a compact size.

Figure 3:
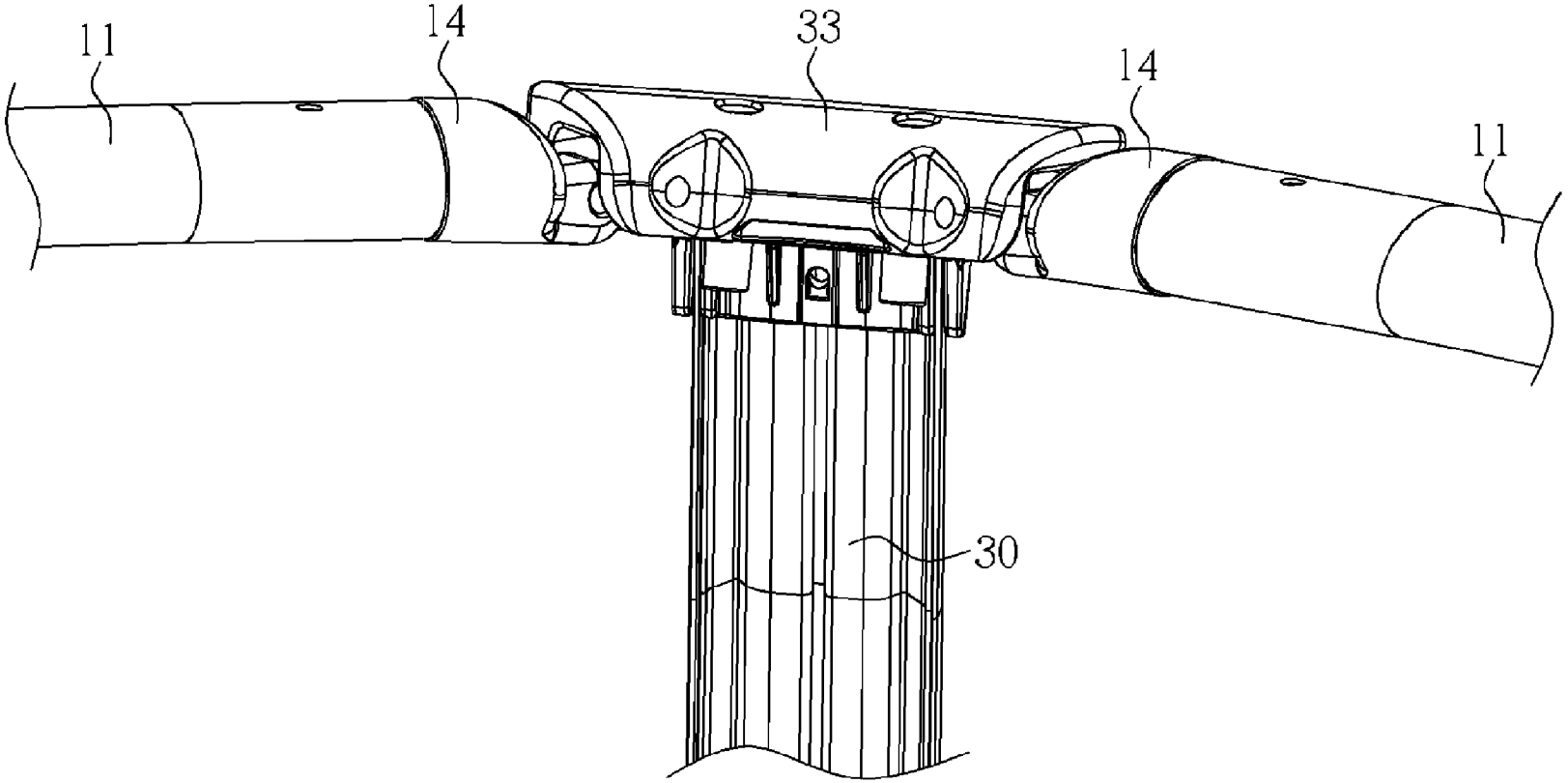
FIG. 3 is an illustration of a top corner and a post body of a standing post assembling to the top rails in the frame body.
Figure 4:
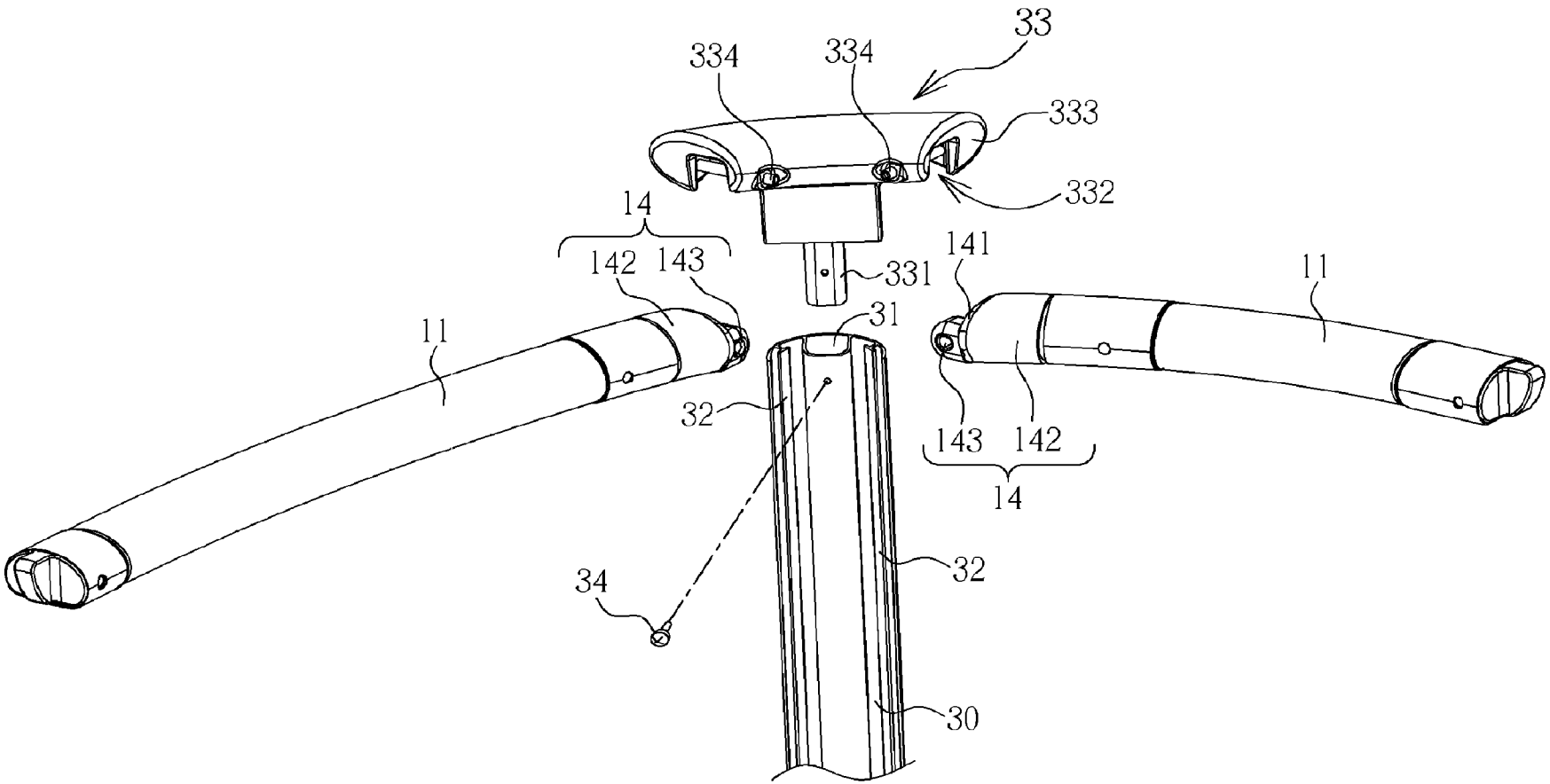
FIG. 4 is an illustration of exploded view of each component in FIG. 3.

Please refer to FIG. 3 and FIG. 4. FIG. 3 is an illustration of the top corner 33 and the post body 30 of one standing post 3 assembling to the top rails 11 in the frame body 10, and FIG. 4 is an illustration of exploded view of each component in FIG. 3. Each corner of the frame body 10 is arc-shaped formed by the top corner 33 and two adjacent top rails 11 pivoting to the top corner 33. The top corner 33 also includes a plug 331 extending downward and a pivoting slot 332 extending laterally. The post body 30 of the standing post 3 is an arc-shaped body in this embodiment and has a socket 31, which has cross-section shape corresponding to the plug 331 of the top corner 33, in the middle of the inner wall of the post body 30. The post body 30 also includes two first engagements 32 locating at two side of the socket 31 and extending downward along the inner wall of the post body 30. Each top rail 11 includes a pivot end 14 at the end. The pivot end 14 includes a body part 142 and a pivoting part 143 extending and protruding laterally from the body part 142. The pivoting part 143 is placed in the pivoting slot 332 of the top corner 33 and a rivet 334 is passed through the top corner 33 and the pivoting part 143 so that the top rail 11 can pivot to the top corner 33 and rotate relative to the top corner 33. In order to prevent the top rail 11 from rotating overly upward relative to the top corner 33 that may deform the frame body 10 when the playard 100 is in an opening status, and also to retain the top rail 11 and the top corner 33 in the opening position as shown in FIG. 2 or FIG. 3, the top corner 33 further has a first inclined surface 333 near the pivoting slot 332 at each side and the top rail 11 also has a second inclined surface 141 corresponding to the first inclined surface 333. The second inclined surface 141 locates at the boundary between the body part 142 and the pivoting part 143 and can abut against the first inclined surface 333 so that the top rail 11 is prevented from overly rotating.

Figure 5:
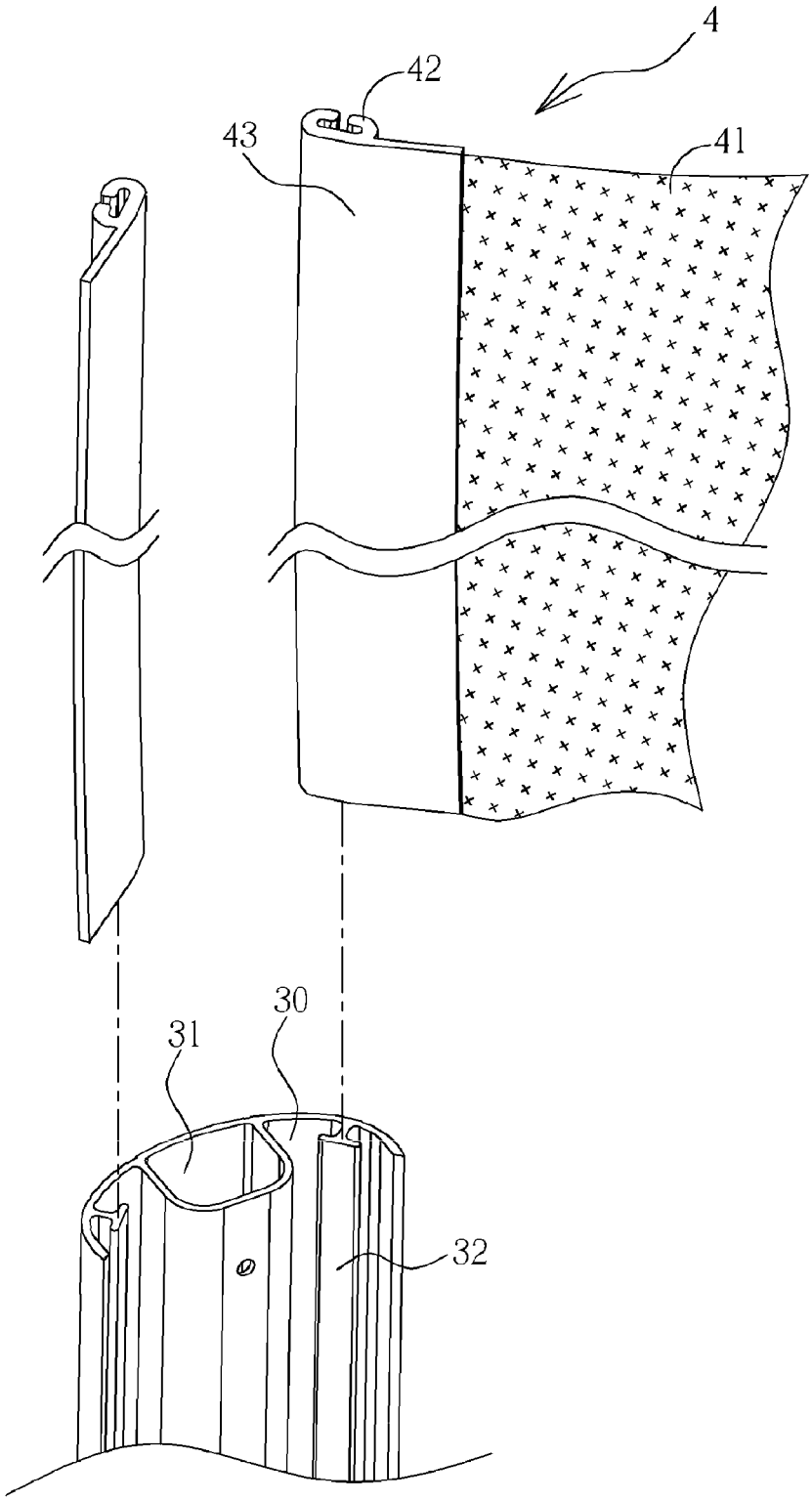
FIG. 5 is an illustration of a first embodiment showing the enclosure to mount on the standing post of the playard.
Figure 6:
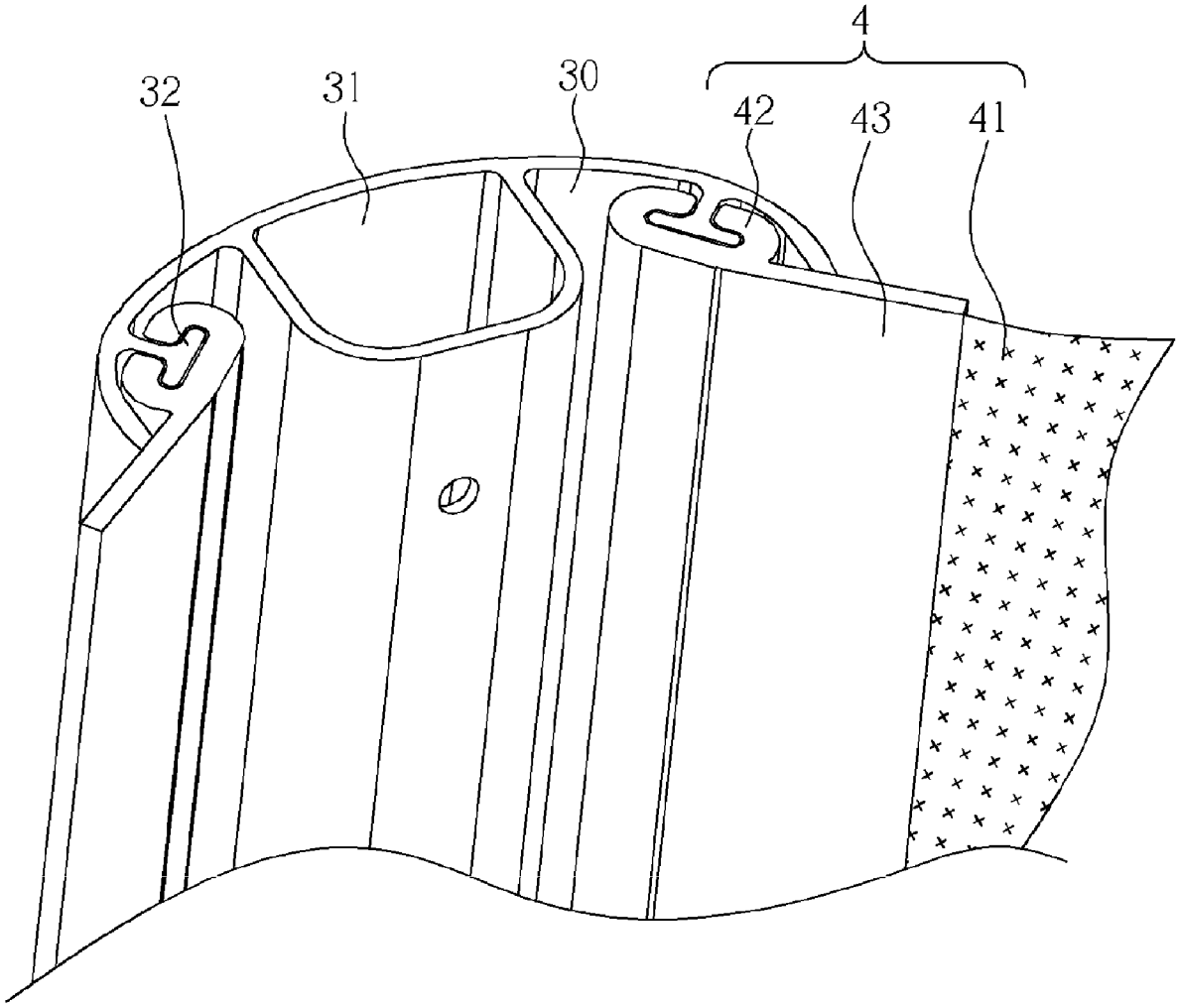
FIG. 6 is an illustration showing the assembled first embodiment.

Please refer to FIG. 5. FIG. 5 is an illustration of a first embodiment showing the enclosure 4 to mount on the standing post 3 of the playard 100. In this embodiment, the enclosure 4 is slidably assembled to the post body 30 of the standing post 3. Two first engagements 32 of the standing post 3 are T-shaped protrusions extending from the inner wall of the post body 30. The enclosure 4 has a connector 43 at the end of the enclosure body 41. The connector 43 includes a second engagement 42 that is a groove in this embodiment and matches with the T-shaped first engagement 32. To assemble the enclosure 4 to the standing post 3, the enclosure 4 is first mounted on the standing post 3 by sliding the second engagement 42 of the enclosure 4 downward along the first engagement 32 of the post body 30. FIG. 6 is an illustration showing the enclosure 4 mounted on the standing post 3. After coupling the plug 331 of the top corner 33 to the socket 31 of the post body 30 in the second step, a fastener 34 (referring to FIG. 4) is passed through the post body 30 and the plug 331 so that the enclosure 4 is secured to the standing post 3. The playard 100 disclosed in the present invention therefore allows easy installation of enclosures 4 due to the design of the engagement between the enclosure 4 and the standing post 3. Users can also conveniently remove the enclosure 4 from the frame body 10 for storage, replacement, or cleaning. In this embodiment, the connector 43, which can be made of PVC or plate-type connector, of the enclosure 4 can directly sew to the enclosure body 41 or wrap around the end of the enclosure body 41.

Figure 7:
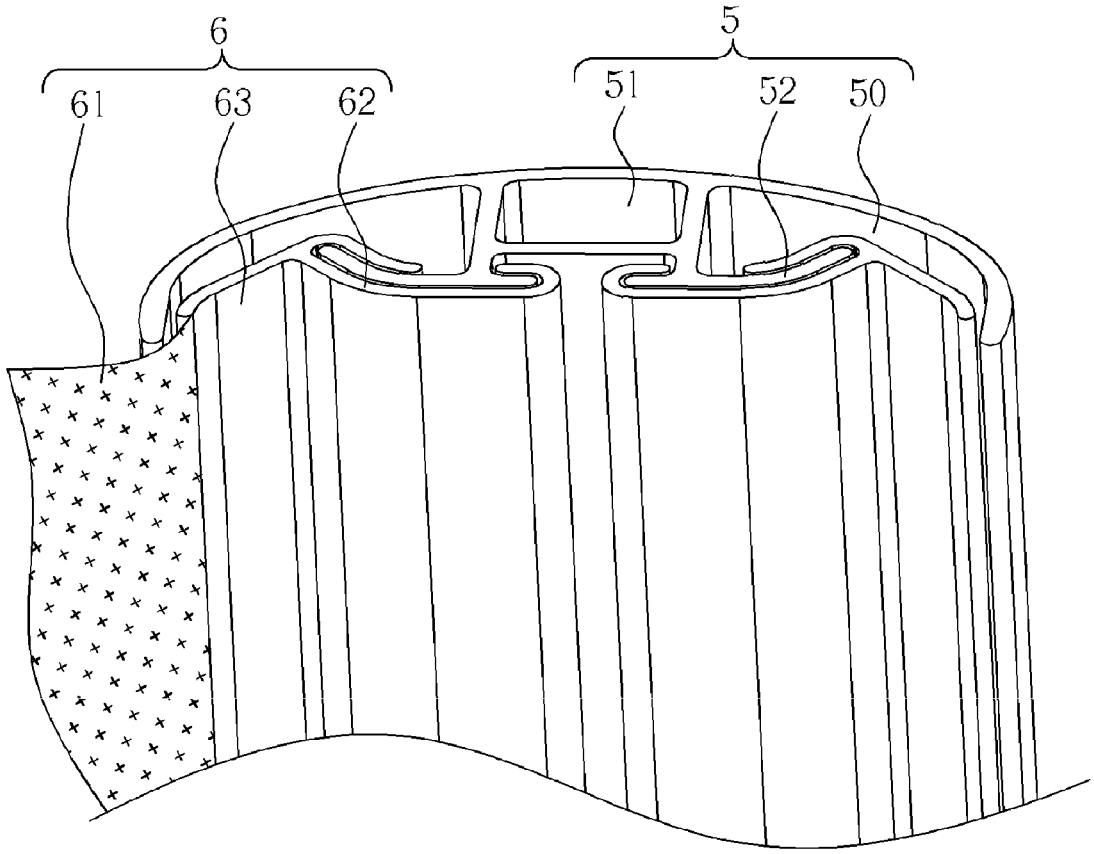
FIG. 7 is an illustration of a second embodiment showing the enclosure mounting on the standing post of the playard.
Figure 8:
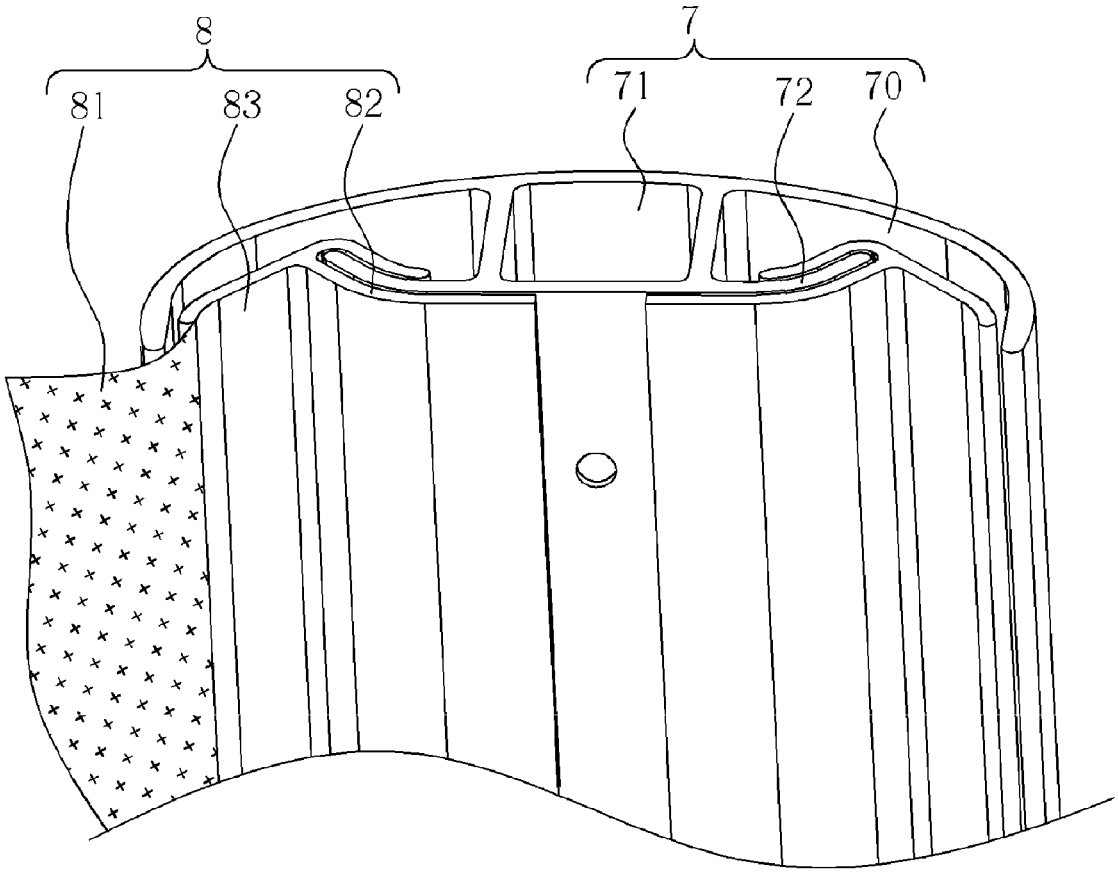
FIG. 8 is an illustration of a third embodiment showing the enclosure mounting on the standing post of the playard.

In addition to the previous first embodiment, FIG. 7 and FIG. 8 further provides two other embodiments showing how the enclosure can be assembled to the standing post of the playard. In the second embodiment in FIG. 7, the post body 50 of the standing post 5 is an arc-shaped post and has a socket 51 in the middle of the inner wall of the post body 50 and two first engagements 52 extending downward along the inner wall of the post body 50. The socket 51 has cross-section that matches the plug of the top corner that is not shown in the figure. The first engagements 52 in this embodiment is T-shaped protrusions extending from the wall at two sides of the socket 51. The enclosure 6 has a connector 63 at the end of the enclosure body 61. The connector 63 includes a second engagement 62, which is a groove for matching with the T-shaped first engagement 52. The groove can slide up and down along the T-shaped protrusion for attaching or detaching the enclosure 6 on the standing post 5. As for the third embodiment in FIG. 8, the post body 70 of the standing post 7 is an arc post and has a socket 71 in the middle of the inner wall of the post body 70 and two first engagements 72 extending from the wall of the socket 71 toward two sides of the post body 70. The enclosure 8 has a connector 83 at the end of the enclosure body 83. The connector 83 includes a second engagement 83, which is a groove for matching with the shape of the first engagement 72. The groove can slide up and down along the first engagement 72 for attaching or detaching the enclosure 8 on the standing post 7. Each embodiment disclosed above is part of the embodiments according to the present invention.

The playard disclosed in the present invention has the frame body that includes the top frame, a plurality of standing posts, and the bottom frame pivoting to one another so that the playard can be foldable. The top corner of the standing post, top rails adjacent to the top corner, and the corresponding post body of the standing post form an arc-shaped surface structure. The top corner is mounted above the post body of the standing post by coupling the plug of the top corner to the socket of the post body. The standing post has two first engagements at two sides of its arc shape post body or on the wall of the socket. The enclosure has a second engagement at one end, which can engage with the first engagement by sliding relative to the standing post so that the enclosure is easily attached to or detached from the standing post. Since the enclosure engages with the corresponding standing post with its full side, the engagement of the enclosure and the standing post is further strengthened.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A playard, comprising:

a frame body comprising a top frame, a bottom frame, and a plurality of standing posts connecting to the top frame and the bottom frame, each standing post having a pair of first engagements; and a plurality of enclosures, each enclosure having a pair of second engagements at two sides for detachably engaging with the corresponding first engagement of the standing post;

wherein each standing post comprises a post body and a top corner mounting on top of the post body, the post body having a socket and the top corner having a plug and mounting on the post body when the plug couples to the socket, the pair of first engagements locating at two opposite sides of the socket respectively for engaging with corresponding enclosure.

2. The playard of claim 1, wherein the first engagements of the standing post are protrusions, the second engagements of the enclosure are grooves corresponding to the protrusions such that the second engagement slidably mounts on the first engagement.

3. The playard of claim 2, wherein the protrusions are T-shaped.

4. The playard of claim 1, wherein the first engagement protrudes from the inner wall of the standing post.

5. The playard of claim 1, wherein the first engagement is a protrusion extending from the wall of the socket.

6. The playard of claim 5, wherein the protrusion forms by extending from the wall of the socket toward two sides of the post body.

7. The playard of claim 1, wherein the post body of the standing post is arc-shaped, the socket locates in the arc middle of the post body.

8. The playard of claim 1, wherein the enclosure comprises an enclosure body and two connectors at two sides of the enclosure body, and the second engagement is disposed at each connector.

9. The playard of claim 1, wherein the standing post comprises a post body and a top corner mounting above the post body, the top frame comprises a plurality of top rails pivoting to the corresponding top corner, each top corner has first inclined surfaces at two sides, each top rail has a second inclined surface at the pivot end that pivots to the top corner, and the first inclined surface abuts against the second inclined surface when the playard is in an opening status.

10. The playard of claim 1, wherein an arc surface forms on the top corner and the adjacent top rails pivoting to the top corner.

11. A playard, comprising:

a frame body, comprising a plurality of standing posts, each standing post having a pair of protrusions; and an enclosure, having a connector at one end, the connector having a groove capable of detachably mounting on the protrusion for assembling the enclosure to the frame body;

wherein one of the standing posts comprises a top corner, the frame body further comprises a first top rail and a second top rail pivoting to the top corner, the top corner has first inclined surfaces at two sides, the first and the second top rails have a second inclined surface respectively near the pivot end that pivots to the top corner for abutting against the corresponding first inclined surface, and an arc surface forms on the top corner.

12. The playard of claim 11, wherein the protrusion protrudes from the inner wall of the standing post.

13. The playard of claim 11, wherein the standing post has a socket on the inner wall and the protrusions extend from the wall of the socket.

14. The playard of claim 11, wherein the protrusions are T-shaped.

* * * * *